US007638701B2

(12) United States Patent
May, Jr.

(10) Patent No.: US 7,638,701 B2
(45) Date of Patent: Dec. 29, 2009

(54) MUSICAL DRUM PRACTICE PADS

(75) Inventor: James H. May, Jr., Palmdale, CA (US)

(73) Assignee: Remo, Inc., Valencia, CA (US)

( * ) Notice: Subject to any disclaimer, the term of this patent is extended or adjusted under 35 U.S.C. 154(b) by 270 days.

(21) Appl. No.: 10/873,526

(22) Filed: Jun. 23, 2004

(65) Prior Publication Data

US 2005/0284283 A1 Dec. 29, 2005

(51) Int. Cl.
*G10D 13/02* (2006.01)

(52) U.S. Cl. ..... 84/411 P; 84/411 R

(58) Field of Classification Search ..... 84/411 P, 84/411 R, 411 M, 470 R
See application file for complete search history.

(56) References Cited

U.S. PATENT DOCUMENTS 2,722,860 A * 11/1955 Pace ..... 84/411 R
3,264,926 A * 8/1966 Belli ..... 84/411 R
3,597,520 A 8/1971 Andrews
4,102,235 A * 7/1978 Le Masters ..... 84/411 R
5,487,320 A * 1/1996 De Mowbray ..... 84/413
5,492,047 A 2/1996 Oliveri
5,520,090 A 5/1996 Eagle
5,744,737 A 4/1998 Carter
5,932,823 A 8/1999 Jacobs
6,175,068 B1 * 1/2001 Belli ..... 84/414
6,239,340 B1 5/2001 Heuerman
6,284,959 B1 9/2001 Nicolosi
6,362,407 B1 * 3/2002 Dennis et al. ..... 84/411 P

* cited by examiner

*Primary Examiner*—Jianchun Qin
(74) *Attorney, Agent, or Firm*—Larry F. Gitlin

(57) ABSTRACT

An apparatus for simulating the playing surface response characteristics of conventional percussion instruments, including one or more metal base members and one or more corresponding percussion pad members with a magnetized pad for magnetic coupling with a metal base member. Each percussion member has response characteristics corresponding to the playing surface characteristic of a particular conventional percussion instrument and is removably positioned relative to each of the metal base members. Also provided is a device for simulating the playing surface response characteristics of a bass drum.

21 Claims, 5 Drawing Sheets

FIG. 7
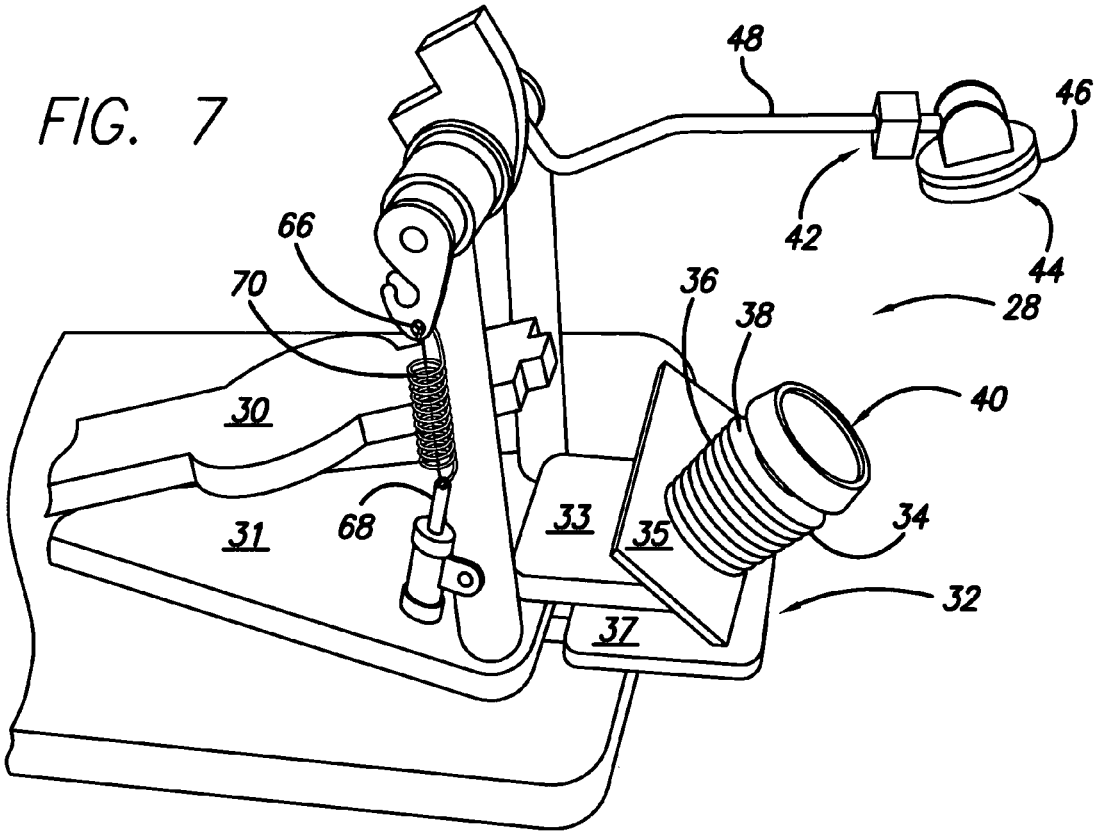
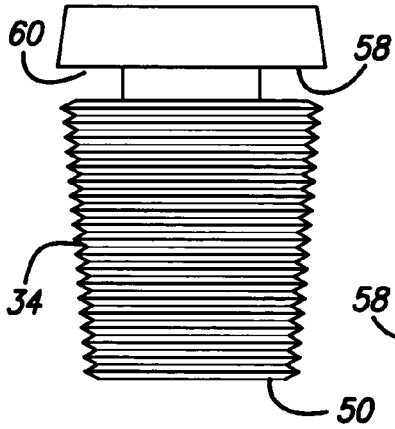
FIG. 8
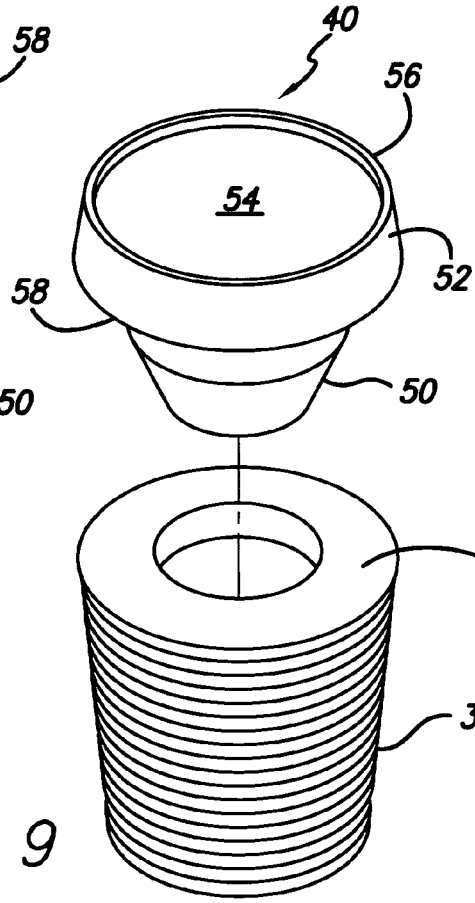
FIG. 9
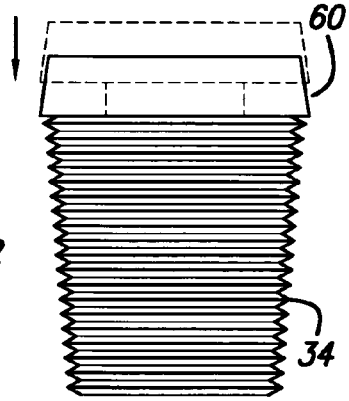
FIG. 10

MUSICAL DRUM PRACTICE PADS

FIELD OF THE INVENTION

The present invention relates generally to the field of musical instruments and, more particularly, to an improved drum practice pad apparatus that simulates the playing surface response characteristics of conventional percussion instruments.

DESCRIPTION OF THE PRIOR ART

Devices for practicing drumming technique and building strength and resiliency in the fingers, hands and wrists to improve both technique and stamina are well known in the prior art. These devices are commonly referred to as drum practice pads. Some are comprised of a sheet rubber material adhered to a wood base. Others consists of a conventional drumhead tensioned over a drumshell with a round shaped shallow body filled with foam. This device, which includes a tunable head, acts to deaden the sound and vibration produced when the drumhead is struck. Still, the sound generated by this device remains relatively loud. The "feel" of the pad can be adjusted to a limited extent by simply loosening or tightening the tensioning rods or screws. However, in order to adjust the "feel" and the sound of the pads to permit the player the experience of a large variety of conventional percussion devices, it becomes necessary to physically remove the drumhead and inject foam material into the drumshell. This is an extremely difficult and burdensome task, in terms of time and effort, to achieve.

Another type of prior art practice pad includes a gum rubber material affixed to a wood base, or some similarly hard surface. Though generally quiet, this pad produces a great deal of bounce or rebound, providing limited usefulness. Also, the pad is not easily removed and replaced with a substitute to produce a different sound and/or "feel". Individual pads can be placed on top of the drumhead of a conventional drum to deaden sound. Yet, these pads also have limited usefulness.

Electronic pads use a mesh material to deaden sound. Other types of electronic pads, which employ an electronic trigger or pick-up device, are complex and expensive to produce.

A search of the prior art did not disclose any patents that read directly on the claims of the present invention. However, the following references are considered related:

| U.S. Pat. No. | Inventor | Issue Date |
|---|---|---|
| 3,264,926 | Remo D. Belli | Aug. 9, 1966 |
| 3,597,520 | Henry S. Andrews | Aug. 3, 1971 |
| 4,102,235 | Laurence G. Le Masters | Jul. 25, 1978 |
| 5,492,047 | Ignazus P. Oliveri | Feb. 20, 1996 |
| 5,520,090 | David Eagle | May 28, 1996 |
| 5,744,737 | Darryl Carter | Apr. 28, 1998 |
| 5,932,823 | Malcolm W. Jacobs | Aug. 3, 1999 |
| 6,239,340 | Kevin Michael Heuerman | May 29, 2001 |
| 6,284,959 | Kathy Lord Nicolosi | Sep. 4, 2001 |
| 6,362,407 | Dennis et al. | Mar. 26, 2002 |

None of the devices disclosed in the prior art teaches a drum practice pad apparatus with the improvements of the present invention, specifically a device that produces the "feel" and sounds that accurately simulate the playing surface response characteristics of conventional percussion instruments. Accordingly, there is a need for the present invention to address and resolve the differences among the devices of the prior art.

SUMMARY OF THE INVENTION

In its preferred embodiment, the present invention provides an apparatus for simulating the playing surface response characteristics of conventional percussion instruments, such as a snare drum, tom-tom, bass drum, cymbals and the like. This apparatus comprises one or more metal base members with each base member having a top surface and a bottom surface, one or more corresponding percussion pad members with each percussion pad member further comprised of a percussion member with an upper playing surface and a bottom surface and a magnetic pad affixed to the bottom surface of each of the percussion members for magnetic coupling with a metal base member. Each of the playing surfaces of a percussion member has response characteristics corresponding to the playing surface characteristics of a particular conventional percussion instrument. The percussion pad is removably positioned relative to each of the metal base members.

Also provided as a component of the present invention is a device for simulating the playing surface response characteristics of a bass drum including a foot pedal, a pedal attachment position forward of the foot pedal, a pad housing with an upper ridge member, a bass pad removably insertable into the pad housing, a beater assembly with a beater head for striking the bass head, and a beater pad mounted on the beater head.

Accordingly, it is an object of the present invention to provide an improved practice pad device.

It is also an object of the present invention to provide an improved practice pad device for simulating the playing surface response characteristics of conventional percussion instruments, including, without limitation, snare drums, tom-toms, bass drums, cymbals and the like.

It is yet another object of the present invention to provide an improved practice pad device that is portable.

It is yet another object of the present invention to provide an improved practice pad device that includes one or more individual percussion members with playing surfaces having response characteristics corresponding to the playing surface characteristics of one or more conventional percussion instruments.

It is yet another object of the present invention to provide an improved practice pad device that includes a percussion member comprised of elastomeric or resilient natural material.

It is yet another object of the present invention to provide an improved practice pad device that includes percussion members that vary in thickness, diameter and weight.

It is yet another object of the present invention to provide an improved practice pad device wherein one or more of the percussion members has a textured upper playing surface for use with wire drum brushes.

It is yet another object of the present invention to provide an improved practice pad device that includes percussion members that vary in density of material composition, and degree of hardness and tension.

It is yet another object of the present invention to provide an improved practice pad device that is easy to use and relatively inexpensive to manufacture.

Other objects and advantages of the present invention will become apparent in the following specifications when considered in light of the attached drawings wherein the preferred embodiment of the invention is illustrated.

BRIEF DESCRIPTION OF THE DRAWINGS

FIG. 7 is a perspective view of a bass drum assembly in accordance with the present invention.

FIG. 8 is an elevational view of the bass pad inserted within the pad housing in accordance with the present invention.

FIG. 9 is a perspective view of the bass pad shown about to be inserted into the pad housing in accordance with the present invention.

FIG. 10 is an elevational view of the bass pad joined with the pad housing in a compressive mode in accordance with the present invention.

DETAILED DESCRIPTION OF THE PREFERRED EMBODIMENT

Figure 1:
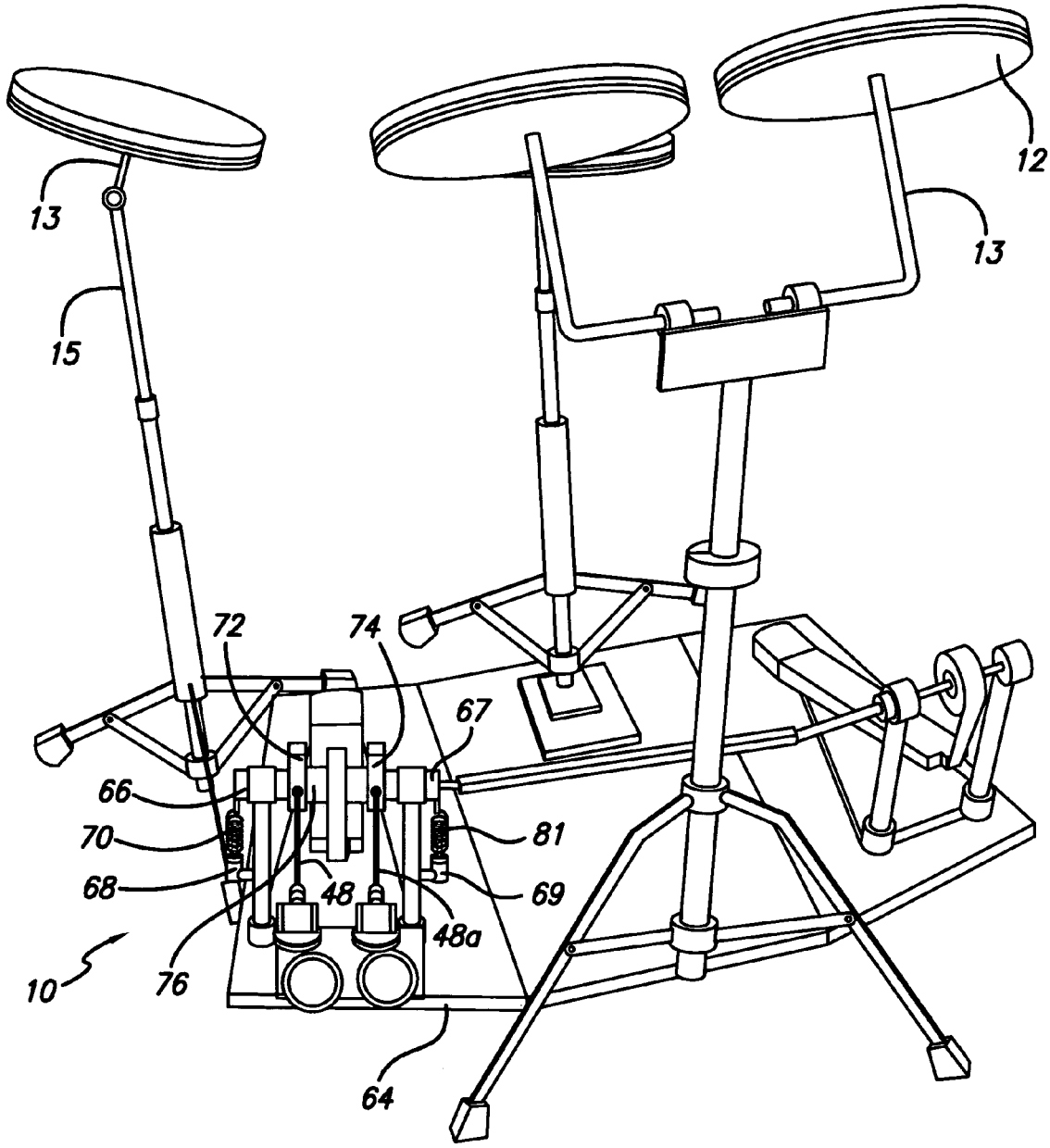
FIG. 1 is a front perspective view of a drum practice pad apparatus in accordance with the present invention.
Figure 2A:
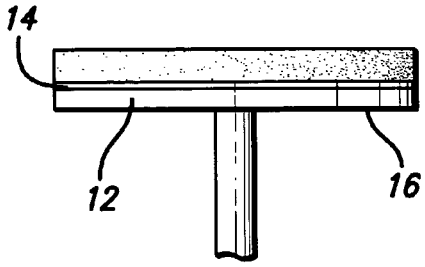
FIG. 2A is an elevational view of a single practice pad constructed in accordance with the present invention.
Figure 2B:
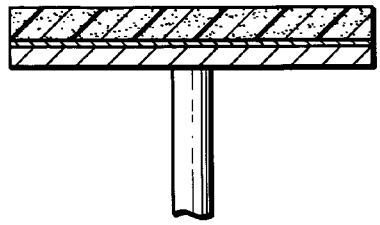
FIG. 2B is a sectional view of the practice pad shown in FIG. 2A.
Figure 3A:
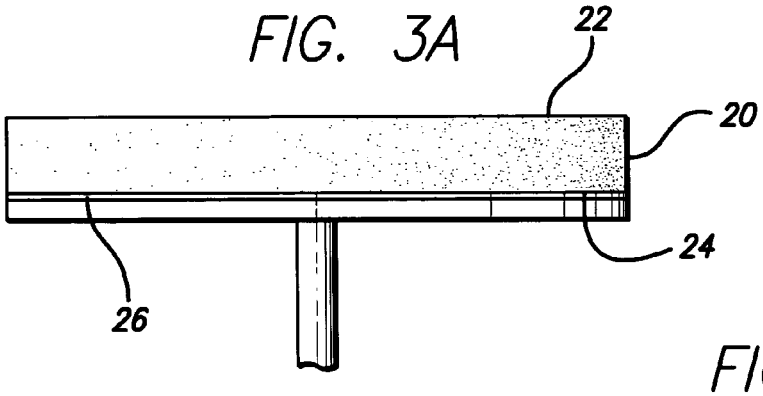
FIG. 3A is an elevational view of a second embodiment of a single practice pad constructed in accordance with the present invention.
Figure 3B:
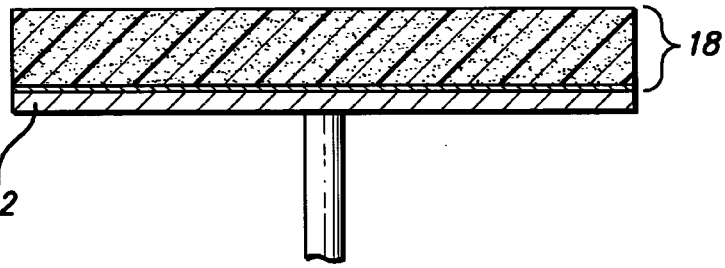
FIG. 3B is a sectional view of the practice pad shown in FIG. 3A.
Figure 4A:
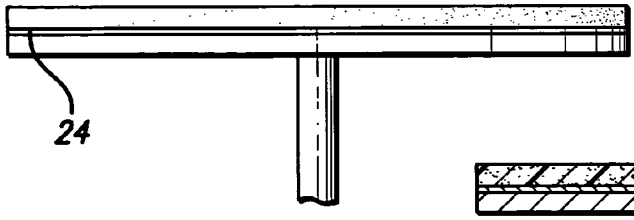
FIG. 4A is an elevational view of a third embodiment of a single practice pad constructed in accordance with the present invention.
Figure 4B:
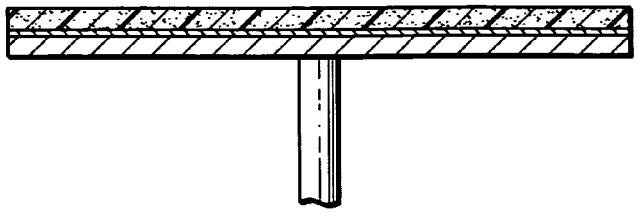
FIG. 4B is a sectional view of the practice pad shown in FIG. 4A.
Figure 5:
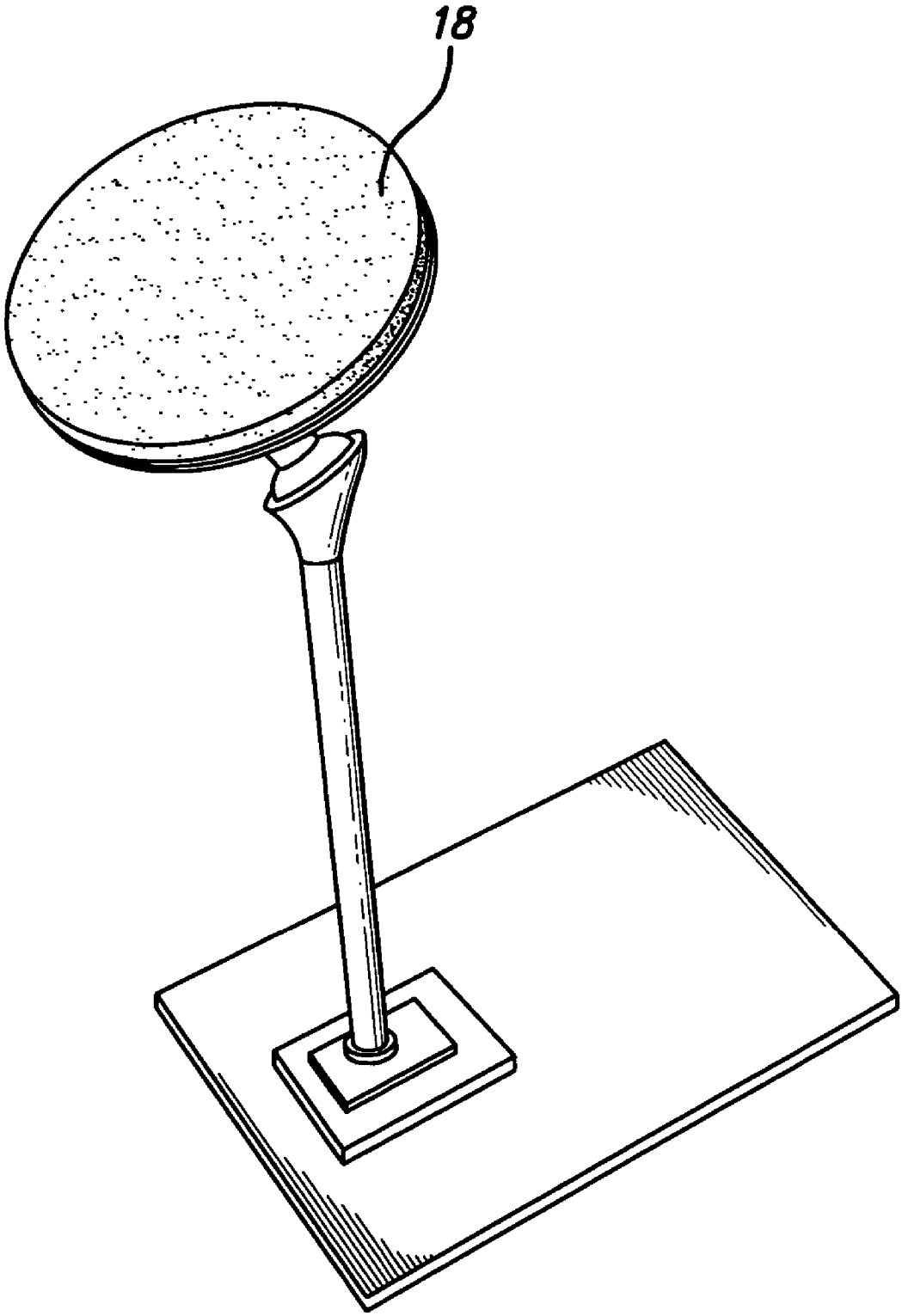
FIG. 5 is a perspective view of a single practice pad constructed in accordance with the present invention supported independently on a stand.
Figure 6A:
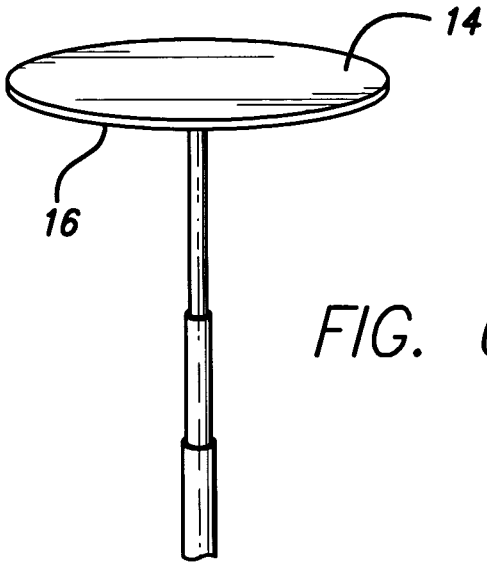
FIG. 6A is a perspective view of a base member supported independently on a stand in accordance with the present invention.
Figure 6B:
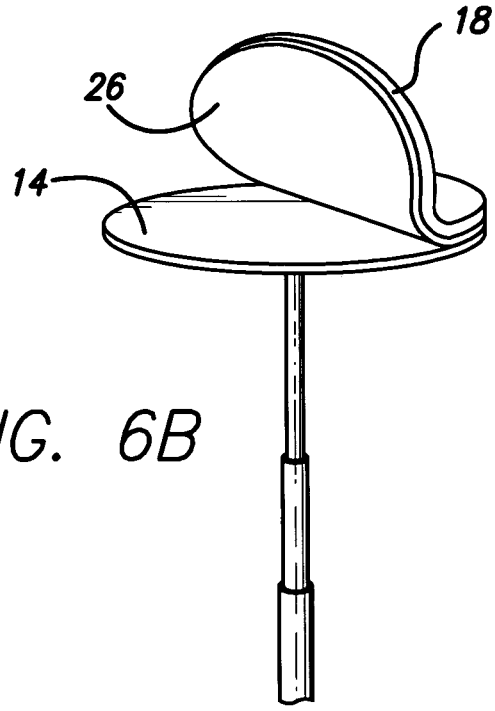
FIG. 6B is a perspective view of a pad being mounted on a base member in accordance with the present invention.
Figure 6C:
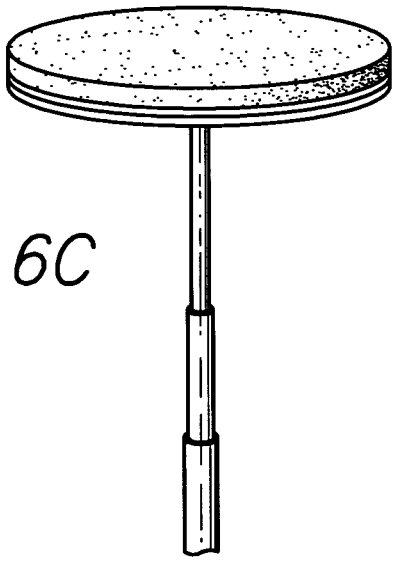
FIG. 6C is a perspective view of a pad shown mounted on a base member in accordance with the present invention.

Referring more particularly to the drawings, FIG. 1 is a perspective view of the preferred embodiment of the present invention depicting a musical drum practice pad apparatus 10 for use in simulating the playing surface response characteristics of conventional percussion instruments, including, without limitation, snare drums, tom-toms, bass drums, cymbals and the like (not shown). Apparatus 10 includes one or more metal base members 12 having a top surface 14 and a bottom surface 16 and one or more percussion pad members 18 individually comprised of a percussion member 20 having an upper surface 22 and bottom surface 24. Also provided is a magnetized pad 26 affixed to the bottom surface 24 of each percussion member 20 for magnetic coupling with top surface 14 of a metal base member 12. Each percussion member 20, including specifically upper playing surface 22, possesses individual response characteristics corresponding to the playing surface response characteristics of one or more of the aforesaid conventional musical instruments. Percussion pad member 18 is removably positioned upon top surface 14 of metal base members 12.

For simulating the playing surface response characteristics of a bass drum (not shown) an assembly 28 of interactive and integrated components are provided, including foot pedal 30, foot pedal base 31, and pedal attachment 32 positioned forward of foot pedal 30. Foot pedal 30 comprises base members 33 and 37, pad housing 34 having a base member 35, side wall 36 and an upper ridge member 38, bass pad 40 removably insertable within pad housing 34, beater assembly 42, which includes beater head 44 for striking bass pad 40 and beater pad 46 on which beater head 44 is mounted and secured. Beater assembly 42 also includes rod member 48, which is movably responsive to the downward motion of foot pedal 30 to force beater head 44 and beater pad 46 in contact relation with bass pad 40. Interacting with foot pedal 30 and rod member 48 is an assembly of components, including connections 66 and 68 attached to opposite ends of spring 70 on one side of foot pedal 30 and connections 67 and 69 attached to opposite ends of spring 81 on the other side, rotating members 72 and 74 attached, respectively, to rod member 48 and rod member 48*a*, and rotating rod member 76 connected to foot pedal 30.

Bass pad 40 comprises insertable conical plug 50 integrally joined with bass pad head 52 having a recessed upper surface 54 confined within an annular ridge 56, and bottom surface 58. Pad housing 34 may or may not be compressible. If compressible through, a space 60 is provided in the area between bottom surface 58 and upper ridge member 38 to enable a desired amount of compression between insertable plug 50 and pad housing 34 when beater head 44 strikes bass pad 40 sufficient to maximize the simulation of the playing surface response characteristics of a particular conventional bass drum. Pad housing 34 supported by base member 35 is mounted on pedal attachment 32 at a prescribed angle of effectiveness necessary for maximizing the simulation of the actual playing surface response characteristics of a conventional bass drum when beater head 44 strikes down upon bass pad 40.

With further reference to the musical drum practice pad apparatus 10 depicted in FIG. 1, each of the metal base members 12 is supported by a rod member 13 which, in turn is supported by a conventional cymbal stand 15 or some other suitable device. A relatively large floor pad 64 is provided to support many of the invention's components and prevent them from moving about or drifting.

Different types of materials can be used to construct the various elements of the present invention, including resilient synthetic or naturally occurring materials for percussion member 20, pure metal or a metal alloy for base member 12, stand 15, rod member 13 and the like, and any of the other components, such as those included in bass drum assembly 28, for which a hard and sturdy material such as metal would be most suitable.

For such components as pad housing 34, bass pad 40, beater head 44, beater pad 46 and insertable plug 50, resilient natural occurring materials, e.g., rubber, or any resilient and sturdy synthetic materials are typically the most suitable.

Magnetized pad 26 may be attached to percussion member 20 employing any suitable adhesive. Pad 26 is constructed of magnetized metal to enable it to attract and hold securely to metal base member 12. When necessary to substitute or replace percussion member 20 with another, member 20 can easily be separated from metal base member 12 and removed. Including percussion member 20, percussion pad member 18, can vary in thickness, diameter, weight, density and degree of tension, depending upon the type of percussion instrument to be simulated.

Typically, the playing surface of percussion member 20 is smooth, particularly when using drum sticks, wooden, plastic or otherwise. When wire drum brushes (not shown) are utilized, a textured surface is generally more suitable.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

The invention claimed is:

1. A drum practice pad apparatus, comprising:

one or more solid metal disc-shaped base members, each of said metal base members having a certain diameter and a top surface and a bottom surface and a first peripheral edge portion;

one or more percussion pad members, each of said percussion pad members having the same diameter as the diameter of each of said metal base members and a second peripheral edge portion and being comprised of an upper pad member having an upper playing surface and a bottom surface, each of said upper playing surfaces, when struck, having response characteristics that duplicate the playing surface response characteristics of acoustical conventional percussion instruments, comprised of one or more snare drums, tom-toms, bass drums or cymbals, and a magnetized pad member uniformly contacting and affixed to the entire expanse of said bottom surface of said upper pad member adapted for magnetic coupling with said top surface of one of said metal base members, said percussion pad member and said metal base member adapted to join in mating engagement, said percussion pad member being adapted to overlay said metal base member and said first and second peripheral edge portions being disposed in substantially aligned relation; and, each of said percussion pad members and said metal base members being adapted in releasable engagement.

2. The apparatus in accordance with claim 1 wherein said metal base member is supported by a stand.

3. The apparatus in accordance with claim 2 wherein said stand comprises a conventional floor cymbal stand.

4. The apparatus in accordance with claim 1 wherein said percussion member is comprised of an elastomeric material.

5. The apparatus in accordance with claim 1 wherein said percussion member is comprised of a natural material.

6. The apparatus in accordance with claim 1 wherein said percussion member varies in thickness.

7. The apparatus in accordance with claim 1 wherein said percussion members vary in diameter.

8. The apparatus in accordance with claim 1 wherein said percussion members vary in weight.

9. The apparatus in accordance with claim 1 wherein said percussion member and said magnetized pad are secured by adhesive.

10. The apparatus in accordance with claim 1 further comprising a means to simulate the playing surface response characteristics of a bass drum including a foot pedal, a pedal attachment positioned forward of said foot pedal, a pad housing, said pad housing having accordion like sidewalls and an upper ridge member, a bass pad removably insertable within said pad housing, a beater assembly, said beater assembly including a beater head for striking said bass pad and a beater pad mounted on said beater head.

11. The apparatus in accordance with claim 10 wherein said beater assembly includes a rod member movably responsive to the downward motion of said foot pedal to force the beater head and beater pad in contact relation with said bass pad.

12. The apparatus in accordance with claim 10 wherein said pad housing is generally tubular.

13. The apparatus in accordance with claim 12 wherein said pad housing is compressible.

14. The apparatus in accordance with claim 10 wherein said bass pad includes an insertable plug with a bass pad head having a recessed upper surface confined within an annular ridge, and a bottom surface.

15. The apparatus in accordance with claim 14 wherein said insertable plug joins with said pad housing to form a space between said bottom surface of said bass pad head and said upper ridge member of said pad housing to enable a controlled compression between said plug and said housing when said beater head strikes said bass pad sufficient to maximize the simulation of the desired playing surface response characteristics of a conventional bass drum.

16. The apparatus in accordance with claim 10 wherein said pad housing is mounted on said pedal attachment at an angle of effectiveness necessary for maximizing and controlling the simulation of the desired playing surface response characteristics of a conventional bass drum when said beater head strikes said bass pad.

17. The apparatus in accordance with claim 1 which is portable.

18. The apparatus in accordance with claim 1 wherein one or more of said percussion members has a textured upper playing surface for use with wire drum brushes.

19. The apparatus in accordance with claim 1 wherein the material comprising said percussion member varies in density.

20. The apparatus in accordance with claim 1 wherein the material comprising said percussion member varies in the degree of hardness.

21. The apparatus in accordance with claim 1 wherein the material comprising said percussion member varies in the degree of tension.

* * * * *